United States Patent [19]

Henzel

[11] Patent Number: 4,737,486

[45] Date of Patent: Apr. 12, 1988

[54] INORGANIC POLYMER SUBBING LAYER FOR DYE-DONOR ELEMENT USED IN THERMAL DYE TRANSFER

[75] Inventor: Richard P. Henzel, Webster, N.Y.

[73] Assignee: Eastman Kodak Company, Rochester, N.Y.

[21] Appl. No.: 79,613

[22] Filed: Jul. 30, 1987

Related U.S. Application Data

[63] Continuation-in-part of Ser. No. 929,048, Nov. 10, 1986, abandoned.

[51] Int. Cl.[4] ..... B41M 5/26

[52] U.S. Cl. ..... 503/227; 8/471; 427/146; 427/256; 428/195; 428/446; 428/448; 428/480; 428/704; 428/913; 428/914; 430/945

[58] Field of Search ..... 8/470, 471; 427/146, 427/256; 428/195, 207, 446–448, 480, 484, 488.1, 488.4, 704, 913, 914; 430/945; 503/227

[56] References Cited

U.S. PATENT DOCUMENTS

| | | | |
|---|---|---|---|
| 2,751,314 | 6/1956 | Keil | 428/354 |
| 2,768,909 | 10/1956 | Haslam | 428/336 |
| 4,021,591 | 5/1977 | De Vries et al. | 428/914 |
| 4,027,345 | 6/1977 | Fujisawa et al. | 428/913 |
| 4,253,838 | 3/1981 | Mizuno et al. | 8/471 |

FOREIGN PATENT DOCUMENTS

| | | | |
|---|---|---|---|
| 138483 | 4/1985 | European Pat. Off. | 428/914 |
| 19138 | of 0000 | Japan | 503/227 |

*Primary Examiner*—Bruce H. Hess
*Attorney, Agent, or Firm*—Harold E. Cole

[57] ABSTRACT

Dye-donor elements and assemblages for thermal dye transfer processing comprising a polymeric support having thereon, in order, a subbing layer and a dye layer comprising a dye dispersed in a binder, and wherein the subbing layer comprises a polymer having an inorganic backbone which is an oxide of a Group IVa or IVb element, preferably titanium, zirconium or silicon. In a preferred embodiment, the polymer is an organic titanate or a titanium alkoxide.

20 Claims, No Drawings

INORGANIC POLYMER SUBBING LAYER FOR DYE-DONOR ELEMENT USED IN THERMAL DYE TRANSFER

This is a continuation-in-part of application Ser. No. 929,048, filed Nov. 10, 1986 now abandoned.

This invention relates to dye-donor elements used in thermal dye transfer, and more particularly to the use of a certain subbing layer between a polymeric support and a dye layer comprising a dye dispersed in a binder.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A problem has existed with the use of dye-donor elements for thermal dye-transfer printing because of a tendency for layer delamination. While various subbing layers have been developed for photographic applications, they are not all suitable for thermal dye transfer, since dye layers for thermal systems are not gelatin based as most photographic emulsions are.

It would be desirable to provide a subbing layer for dye-donor elements used in thermal dye transfer which would provide superior adhesion between a polymeric support and a dye layer comprising a dye dispersed in a binder.

In Japanese laid open publication number 19,138/85, an image-receiving element for thermal dye transfer printing is disclosed. In Example 3 of that publication, a dye-donor element is also described which indicates that a gelatin subbing layer of 2 g/m$^2$ is located between the dye layer and the support. The subbing layers of this invention provide better adhesion than gelatin layers, as will be shown by comparative tests hereinafter.

U.S. Pat. Nos. 2,751,314 and 2,768,909 describe various alkyl titanates. There is no disclosure in these patents, however, that such titanates would be useful in dye-donor elements for thermal dye transfer.

A dye-donor element according to this invention for thermal dye transfer comprises a polymeric support having thereon, in order, a subbing layer and a dye layer comprising a dye dispersed in a binder, and wherein the subbing layer comprises a polymer having an inorganic backbone which is an oxide of Group IVa or IVb element.

In a preferred embodiment of the invention, the Group IVa or Group IVb element is titanium, zirconium or silicon. In another preferred embodiment, the polymer is formed from an organic titanate, such as tetrakis(2-ethylhexyl)titanate, bis(ethyl-3-oxobutanolato-O$^1$,O$^3$)bis(2-propanolato-titanium, or isopropyl triisostearoyl titanate; or is formed from a titanium alkoxide, such as titanium tetra-isopropoxide or titanium tetra-n-butoxide.

The titanium alkoxides are believed to undergo hydrolysis at varying rates to form the inorganic polymer. They thus act as surface water scavengers.

The subbing layer of the invention may be employed at any concentration which is effective for the intended purpose. In general, good results have been obtained at from about 0.01 to about 1.0 g/m$^2$ of coated element. If desired, a polymeric binder may be added to the subbing layer.

Any polymeric binder may be employed in the dye-donor element of the invention. In a preferred embodiment, the binder contains hydroxyl, amino, thio, amido, and/or carboxyl groups. For example, there may be employed cellulosic binders, such as cellulose acetate, cellulose triacetate (fully acetylated) or a cellulose mixed ester such as cellulose acetate butyrate, cellulose acetate hydrogen phthalate, cellulose acetate formate, cellulose acetate propionate, cellulose acetate pentanoate, cellulose acetate hexanoate, cellulose acetate heptanoate, or cellulose acetate benzoate.

The polymeric binder in the dye-donor element of the invention may be employed at any concentration which is effective for the intended purpose. In general, good results have been obtained at from about 0.05 to about 5 g/m$^2$ of coated element.

Any polymeric material can be used as the support for the dye-donor element of the invention provided it is dimensionally stable and can withstand the heat of the thermal printing heads. Such materials include polyesters such as poly(ethylene terephthalate); polyamides; polycarbonates; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 $\mu$m.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

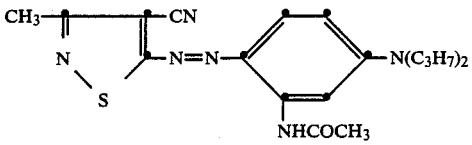

(magenta)

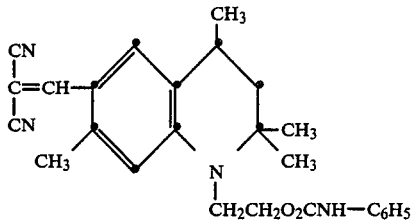

(yellow)

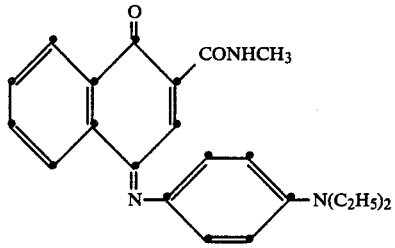

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye layer of the dye-donor element may be coated on the support or printed thereon by a printing technique such as a gravure process.

The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), perfluorinated alkyl-sulfonamidoalkyl acrylate copolymerized with a polyoxyethylene-4-thiaheptandioate ester such as L2277® or L2200® supplied commercially by 3M Company, carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyle cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 weight %, preferable 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyester with a white pigment incorporated therein is employed. The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a polymeric support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOOl), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

Example 1-Tape tests (A) A magenta dye-donor element in accordance with the invention was prepared by coating the following layers in the order recited on a 6 μm poly(ethylene terephthalate) support:

(1) Subbing layer as indicated hereinafter (0.054 g/m$^2$), coated from ethanol, isopropylalcohol, or n-butyl alcohol solvent, and (2) Dye layer containing the following magenta dye (0.17 g/m$^2$), cellulose acetate propionate binder (2.5% acetyl and 45% propionly) (0.32 g/m$^2$) and FC-431 ® surfactant (3M Corp.) (0.0022 g/m$^2$) coated from a butanone and cyclopentanone solvent mixture.

Magenta Dye

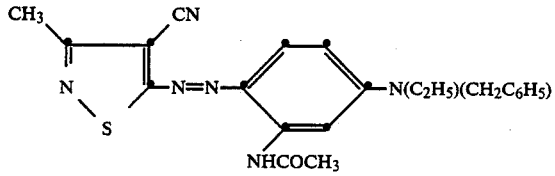

(B) A cyan dye-donor element was prepared similar to (A), except that the dye layer contained the cyan dye illustrated above (0.26 g/m$^2$), cellulose acetate propionate binder (2.5% acetyl and 45% propionyl) (0.39 g/m$^2$) and FC-431 ® surfactant (3M Corp.) (0.0022 g/m$^2$) coated from a butanone and cyclopentanone solvent mixture.

(C) A yellow dye-donor element was prepared similar to (A), except that the dye layer contained the following yellow dye (0.19 g/m$^2$), cellulose acetate propionate binder (2.5% acetyl and 45% propionyl) (0.29 g/m$^2$) and FC-431 ® surfactant (3M Corp.) (0.0022 g/m$^2$) coated from a butanone and cyclopentanone solvent mixture.

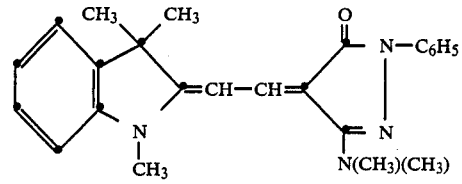

(D) Control dye-donor elements were prepared similar to (A), (B) and (C) except that there was no subbing layer.

(E) Other control elements were prepared similar to (B), except that the subbing layer was gelatin at the coverage indicated in Table 1 and 0.011 g/m$^2$ of Zonyl FSN ® surfactant (duPont Corp.).

The following materials were evaluated in the subbing layers:

duPont Tyzor TPT ®, indicated to be titanium tetra-isopropoxide, a reactive covalent organic titanate.

duPont Tyzor TBT ®, indicated to be titanium tetra-n-butoxide, a reactive covalent organic titanate.

duPont Tyzor GBA ®, indicated to be a mixed titanium bis-alkoxide bis-acetylacetonate, a reactive and covalent titanate.

Each dye-donor element was subjected to a tape adhesion test. A small area (approximately ½ inch×2 inches) of 3M Highland ® 6200 Permanent Mending tape was firmly pressed by hand to the top of the element leaving enough area free to serve as a handle for pulling the tape. Upon manually pulling the tape. Upon manually pulling the tape, none of the dye layer would be removed in an ideal situation. When dye layer was removed, this indicated a weak bond between the support and the coated dye layer. The following categories were established:

E-excellent (no dye layer removal)

G-good (negligible quantities and areas of dye layer removal)

F-fair (small quantities and areas of dye layer removal

P-poor (substantial areas of dye layer removal)

U-unacceptable (dye layer completely removed)

The following results were obtained:

TABLE 1

| Donor Element | Subbing Layer (g/m$^2$) | Tape Test Cyan | Magenta | Yellow |
|---|---|---|---|---|
| Control | None | U | U | U |
| Control | Gelatin (0.054) | U | — | — |
| Control | Gelatin (0.110) | U | — | — |
| Control | Gelatin (0.220) | U | — | — |
| Control | Gelatin (1.000) | U | — | — |
| Control | Gelatin (2.000) | U | — | — |
| B | Tyzor TPT (0.011) | F | — | — |
| B | Tyzor TPT (0.022) | G | — | — |
| A, B, C | Tyzor TPT (0.054) | E | E | E |
| A, B, C | Tyzor TPT (0.110) | E | E | E |
| B | Tyzor TBT (0.011) | F | — | — |
| B | Tyzor TBT (0.022) | F | — | — |
| A, B, C | Tyzor TBT (0.054) | E | E | E |
| B, C | Tyzor GBA (0.054) | E | E | E |

The results indicate that the donor element having a subbing layer in accordance with the invention provided superior adhesion, in contrast to the control elements having no subbing layer or a gelatin subbing layer, which had unacceptable adhesion.

Example 2-Sticking Tests

This example used the same dye-donors as in Example 1 to evaluate their relative release properties from a dye-receiver after thermal dye-transfer printing.

Dye-receiving elements were prepared by coating a solution of Makrolon 5705® (Bayer A. G. Corporation) polycarbonate resin (2.9 g/m$^2$) in a methylene chloride and trichloroethylene solvent mixture on an ICI Melinex 990® white polyester support.

The dye side of the dye-donor element strip one inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head L-133 (No. C6-0242) and was pressed with a spring at a force of 8 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated at increments from 0 up to 8.3 msec to generate a graduated density test pattern. The voltage supplied to the print head was approximately 21 v representing approximately 1.5 watts/dot (12 mjoules/dot) for maximum power.

The relative degree of sticking or lack thereof was evaluated by manual separation of the dye-donor element from the dye-receiving element. The following results were obtained:

TABLE 2

| Donor Element | Subbing Layer (g/m$^2$) | Sticking of Donor to Receiver | | |
|---|---|---|---|---|
| | | Cyan | Magenta | Yellow |
| Control | None | Ext. | Ext. | Ext. |
| Control | Gelatin (0.054) | Ext. | | |
| Control | Gelatin (0.110) | Ext. | | |
| Control | Gelatin (0.220) | Ext. | | |
| Control | Gelatin (1.000) | Ext. | | |
| Control | Gelatin (2.000) | some | | |
| B | Tyzor TPT (0.011) | v. little | | |
| B | Tyzor TPT (0.022) | none | | |
| A, B, C | Tyzor TPT (0.054) | none | none | none |
| A, B, C | Tyzor TPT (0.110) | none | none | none |
| B | Tyzor TBT (0.011) | v. little | | |
| B | Tyzor TBT (0.022) | none | | |
| A, B, C | Tyzor TBT (0.054) | none | none | none |
| B, C | Tyzor GBA (0.054) | v. little | v. little | v. little |

Ext. = extensive

The above data shows that the use of a titanium alkoxide subbing layer between the support and dye layer provides easier separation of the dye-donor from the dye-receiver.

Example 3-Polyimide Support (A) A cyan dye-donor element in accordance with the invention was prepared by coating the following layers in the order recited on a 75 μm duPont Kapton® support (a polyimide based on 4-aminophenyl ether and pyromellitic dianhydride):

(1) Subbing layer of duPont Tyzor TBT® from a 0.5% solution in 1-butanol at 22 ml/m$^2$, and (2) Dye layer containing 0.22 ml/m$^2$ from a butanone-cyclohexanone solvent mixture of a solution of the cyan dye of Example 1 (1.25% by weight), cellulose acetate propionate binder (2.5% acetyl and 45% propionyl) (1.25% by weight) and Dow-Corning 510® silicone fluid (0.004% by weight). Another dye-donor element was prepared as a control without the subbing layer.

The tape test was run as in Example 1. The following results were obtained:

TABLE 3

| Donor Element | Subbing Layer | Tape Test |
|---|---|---|
| Control | None | U |
| A | Tyzor TPT | E |

The results indicate that the subbing layer of the invention provided superior adhesion to the polyimide support in contrast to the control element having no subbing layer.

Example 4-Zirconium and Silicon Alkoxides

Monochrome dye-donors were prepared by coating the indicated alkoxide or silane from either ethanol or 1-propanol solvent on a duPont Mylar, 6 μm Type 24C, support. On top of this subbing layer was coated a dye-layer of cyan dye as in Example 1 (0.28–0.26 g/m$^2$) and one of the following three binders (0.44–0.47 g/m$^2$) coated from a toluene, methanol and cyclopentanone solvent mixture. Control coatings were also prepared without any subbing layer.

The invention alkoxides evaluated were:

Zirconium tetra-n-propoxide $Zr(OCH_2CH_2CH_3)_4$

Available commercially from Alfa Products.

An amino-silane

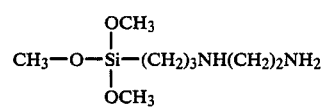

N-(β-aminoethyl)-γ-aminopropyltrimethoxysilane (This material was partially acidified with 27 mg/m$^2$ 1M acetic acid before coating.)

Available commercially from Dow Corning as Z-6020®.

An amino silane

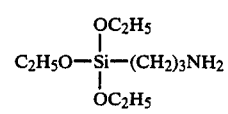

γ-aminopropyltriethoxysilane (This material was partially acidified with 170 mg/m$^2$ 1M acetic acid.)

Available commercially from Aldrich Chemical 11,339.

The three dye-binder polymers used were:

(a) Cellulose acetate propionate (2.5% acetyl, 45% propionyl)

(b) Butvar 76® (Monsanto Company) poly(vinyl alcohol-co-benzal) (9–13% polyvinyl alcohol)

(c) Butvar 98® (Monsanto Company) As (b) but 18–20% polyvinyl alcohol.

Each dye-donor coating was subjected to a tape adhesion test as described in Example 1.

The following results were obtained:

TABLE 4

| Subbing layer (g/m$^2$) | Donor Binder | Tape Test |
|---|---|---|
| None (control) | a | U |
| None (control) | b | U |
| None (control) | c | U |
| Zirconium alkoxide (0.11) | a | E |
| Zirconium alkoxide (0.11) | b | E |
| Zirconium alkoxide (0.11) | c | E |
| Trimethoxy silane (0.11) | a | E |
| Trimethoxy silane (0.11) | b | E |
| Trimethoxy silane (0.11) | c | F |
| Triethoxy silane (0.07) | a* | G |

*This donor also contained FC-430 ® (3M Corp.) at 2 mg/m$^2$.

Each dye-donor was also used for printing evaluations as described in Example 2. The receiver used was similar to that of Example 2 except that it also contained 1,4-dimethyl-2,5-didecoxybenzene (0.38 g/m$^2$), 3M Corp. FC-431® (32–48 mg/m$^2$), and Dow Corning DC-510® silicone fluid (11–54 mg/m$^2$) on a polyethylene-coated paper support.

The control dye-donors all showed extensive sticking of the donor to the receiver. No donor-receiver sticking was experienced with the zirconium compound layers and some sticking was observed with the silane compound layers except those with the cellulose acetate propionate binder. The degree of sticking, however, was less than with the controls containing no subbing layer.

This experiment shows that improved adhesion and printing performance is obtained with a variety of dye donor binders using the subbing layers of the invention.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a polymeric support having thereon, in order, a subbing layer and a dye layer comprising a dye dispersed in a binder, the improvement wherein said subbing layer comprises a polymer having an inorganic backbone which is an oxide of a Group IVa or IVb element.

2. The element of claim 1 wherein said Group IVa or IVb element is titanium, zirconium or silicon.

3. The element of claim 1 wherein said subbing layer polymer is formed from an organic titanate.

4. The element of claim 1 wherein said subbing layer polymer is formed from a titanium alkoxide.

5. The element of claim 4 wherein said titanium alkoxide is titanium tetra-isopropoxide.

6. The element of claim 4 wherein said titanium alkoxide is titanium tetra-n-butoxide.

7. The element of claim 1 wherein said dye layer comprises a sublimable dye dispersed in a binder which contains hydroxyl, amino, thio, amido and/or carboxyl groups.

8. The element of claim 7 wherein said binder is a cellulosic binder.

9. The element of claim 1 wherein said polymeric support is poly(ethylene terephthalate).

10. In a process of forming a dye transfer image comprising (a) imagewise-heating a dye-donor element comprising a polymeric support having thereon, in order, a subbing layer and a dye layer comprising a dye dispersed in a binder, and (b) transferring a dye image to a dye-receiving element to form said dye transfer image, the improvement wherein said subbing layer comprises a polymer having an inorganic backbone which is an oxide of a Group IVa or IVb element.

11. The process of claim 10 wherein said support is coated with sequential repeating areas of cyan, magenta and yellow dye, and said process steps are sequentially performed for each color to obtain a three-color dye transfer image.

12. In a thermal dye transfer assemblage comprising:

(a) a dye-donor element comprising a polymeric support having thereon, in order, a subbing layer and a dye layer comprising a dye dispersed in a binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said subbing layer comprises a polymer having an inorganic backbone which is an oxide of a Group IVa or IVb element.

13. The assemblage of claim 12 wherein said Group IVa or IVb element is titanium, zirconium or silicon.

14. The assemblage of claim 12 wherein said subbing layer polymer is formed from an organic titanate.

15. The assemblage of claim 12 wherein said subbing layer polymer is formed from a titanium alkoxide.

16. The assemblage of claim 15 wherein said titanium alkoxide is titanium tetra-isopropoxide.

17. The assemblage of claim 15 wherein said titanium alkoxide is titanium tetra-n-butoxide.

18. The assemblage of claim 12 wherein said dye layer comprises a sublimable dye dispersed in a binder which contains hydroxyl, amino, thio, amido and/or carboxyl groups.

19. The assemblage of claim 18 wherein said binder is a cellulosic binder.

20. The assemblage of claim 12 wherein the support of the dye-donor element is poly(ethylene terephthalate).

* * * * *